United States Patent [19]

Cook et al.

[11] Patent Number: 4,897,167

[45] Date of Patent: Jan. 30, 1990

[54] ELECTROCHEMICAL REDUCTION OF $CO_2$ TO $CH_4$ AND $C_2H_4$

[75] Inventors: Ronald L. Cook, Aurora; Robert C. MacDuff; Anthony F. Sammells, both of Naperville, all of Ill.

[73] Assignee: Gas Research Institute, Chicago, Ill.

[21] Appl. No.: 234,387

[22] Filed: Aug. 19, 1988

[51] Int. Cl.[4] ..... C25C 1/12; C25B 3/04

[52] U.S. Cl. ..... 204/52.1; 204/72; 204/292; 204/294; 204/290 R; 204/290 F; 204/130; 204/140

[58] Field of Search ..... 204/59 R, 120, 35.1, 204/52.1, 72, 140, 292, 294, 290 R, 290 F, 130

[56] References Cited

PUBLICATIONS

Hori, V., K. Kikuchi, A. Murata and S. Suzuki, Chem. Lett., 897, (1986).

De Wulf, D. W., A. J. Bard, Cat. Lett. 1, 73, (1988).

Lain, M. J. and D. Pletcher, Electrochim. Acta., 32, 99, (1987).

Petrova, G. N. and O. N. Efimova, Elektrokhimiya, 19(7), 978, (1983).

Frese, Jr., K. W. and S. Leach, J. Electrochem. Soc., 132, 259, (1985).

Hori, Y., K. Kikuchi and S. Suzuki, Chem. Lett., 1695, (1985).

Hori, Y., A. Murata, R. Takahashi and S. Suzuki, J. Chem. Soc., Chem. Commun., 17, 1988.

Hori, Y., A. Murata, R. Takahashi and S. Suzuki, J. Am. Chem. Soc., 109, 5022, (1987).

Hori, Y., A. Murata, R. Takahashi and S. Suzuki, Chem. Lett., 1665, (1987).

Cook, R. L., R. C. McDuff and A. F. Sammells, J. Electrochem. Soc., 134, 1873, (1987).

Dewulf, D. W., A. J. Bard, Cat. Lett. 1, 73, (1988).

Czerwinski, A., J. Sobkowski and R. Marassi, Anal. Lett., 18, 1717, (1985).

Lain, M. J. and D. Pletcher, Electrochim, Acta., 32, 99, (1987).

*Primary Examiner*—John F. Niebling

*Assistant Examiner*—Kathryn Gorgos

*Attorney, Agent, or Firm*—Thomas W. Speckman

[57] ABSTRACT

A process for electrochemical reduction of $CO_2$ to $CH_4$ and $C_2H_4$ providing both high current densities and high Faradaic efficiencies. The process is carried out in an electrochemical cell wherein copper is electrodeposited in situ on the cathode surface making freshly deposited copper available for the electrochemical reduction. Faradaic efficiencies of about 75 to about 98 percent for production of $CH_4$ and $C_2H_4$ are obtained.

26 Claims, No Drawings

ELECTROCHEMICAL REDUCTION OF $CO_2$ TO $CH_4$ AND $C_2H_4$

BACKGROUND OF THE INVENTION

1. Field of the Invention

This invention relates to a process for electrochemical reduction of $CO_2$ to $CH_4$ and $C_2H_4$ providing both high current densities and high Faradaic efficiencies. The process is carried out in an electrochemical cell wherein copper is electrodeposited in situ on the cathode surface during at least initial cell operation. Faradaic efficiencies of 73 percent for $CH_4$ and 25 percent for $C_2H_4$ at a current density of 8.3 mA/cm$^2$ have been obtained.

2. Description of the Prior Art

Considerable effort has been expended towards promoting the electrochemical reduction of $CO_2$ to useful hydrocarbons at both high Faradaic efficiencies and high current densities. While a number of chemical catalysts have been identified for $CO_2$ reduction to methane and higher hydrocarbons in the gas phase, relatively few catalysts have been identified for electrochemical reduction of $CO_2$ to hydrocarbons in an aqueous electrolyte.

Indirect reduction of $CO_2$ on a mercury electrode in an aqueous electrolyte, pH 7, containing $TiCl_3$, $Na_2MoO_4$ and pyrocatechol where the total Faradaic efficiency for cathodic hydrocarbon generation was about 0.2 percent at 7 mA/cm$^2$, with methane being the major hydrocarbon component, is taught by Petrova, G. N. and O. N. Efimova, Elektrokhimiya, 19(7), 978 (1983). $CO_2$ has been shown to be reducible to $CH_4$, CO, and methanol at ruthenium cathodes in $CO_2$ saturated aqueous $Na_2SO_4$ electrolyte with Faradaic efficiencies for $CH_4$ production up to 42 percent at current densities up 0.11 mA/cm$^2$ by Frese, Jr., K. W. and S. Leach, J. Electrochem. Soc., 132, 259 (1985).

Copper, 99.99 percent pure, was used as a cathode with 0.5M $KHCO_3$ electrolyte for the electrochemical reduction of $CO_2$ at ambient temperature and current density of 5.0 mA/cm$^2$ for 30 to 60 minutes with Faradaic efficiencies for $CH_4$ of 37 to 40 percent, Hori, Y, K. Kikuchi and S. Suzuki, Chem. Lett., 1695 (1985). In later work, high purity copper cathodes, 99.999 percent, were used for the electrochemical reduction of $CO_2$ in 0.5M $KHCO_3$ electrolyte in a cell operated at a current of 5 mA/cm$^2$ for 30 minutes at temperatures of 0° C. and 40° C., shows Faradaic efficiency for production of $CH_4$ drops from 60 percent at 0° to 5 percent at 4020 ; $C_2H_4$ increases from 3 percent at 0° to 18 percent at 40°; while hydrogen production increases from 20 percent at 0° to 45 percent at 40°. It is stated that 99.99 percent pure copper cut the Faradaic efficiencies to about one-third of those obtained with 99.999 percent pure copper. Hori, Y, K. Kikuchi, A. Murata and S. Suzuki, Chem. Lett., 897 (1986). Later work of electrochemical reduction of $CO_2$ at a 99.999 percent pure copper cathode in aqueous electrolytes of KCl, $KClO_4$, and $K_2SO_4$ at 19° C. and current density of 5 mA/cm$^{-2}$ showed Faradaic yields of $C_2H_4$ of as high as in the order of 48 percent, $CH_4$ 12 percent and EtOH 21 percent. Hori, Y, A. Murata, Takahashi and S. Suzuki, J. Chem. Soc., Chem. Commun, 17, 1988.

Electroreduction of CO at a 99.999 percent pure copper cathode in an aqueous catholyte of $KHCO_3$ at ambient temperature for 30 minutes showed hydrogen to be the predominant product, and at 1.0 mA/cm$^2$, $C_2H_4$ Faradaic production was 22 percent, $CH_4$ 1 percent; 2.5 mA/cm$^2$ $C_2H_4$ Faradaic production was 21 percent, $CH_4$ 16 percent and at 5.0 mA/cm$^2$ $C_2H_4$ Faradaic production was 16 percent, $CH_4$ 6 percent. Hori, Y, A. Murata, R. Takahashi and S. Suzuki, J. Am. Chem. Soc., 109, 5022 (1987). Similar work by the same authors showed electroreduction of CO at a 99.999 percent pure copper cathode in an aqueous 0.1M $KHCO_3$ pH 9.6 catholyte at 19° C. at 2.5 mA/cm$^2$ resulted in Faradaic production $C_2H_4$ of 21.2 percent; $CH_4$ of 16.3 percent; EtOH of 10.9 percent; and 45.5 percent $H_2$. Hori, Y, A. Murata, R. Takahashi and S. Suzuki, Chem. Lett., 1665 (1987).

In the reduction of $CO_2$ to $CH_4$ using 99.9 percent pure cold rolled B 370 copper cathodes with a $CO_2$ saturated 0.5M $KHCO_3$ electrolyte, Faradaic efficiencies of 33 percent were achieved for $CH_4$ at current densities up to 38 mA/cm$^2$ with no $C_2H_4$ being detected. Cook, R. L., R. C. McDuff and A. F. Sammells, J. Electrochem. Soc., 134, 1873 (1987).

Electrochemical reduction of $CO_2$ to $CH_4$ and $C_2H_4$ was shown to occur at copper/Nafion electrodes (solid polymer electrolyte structures) at Faradaic efficiencies of about 9 percent for each $CH_4$ and $C_2H_4$ at $E=-200V$ vs. SCE using 2 mM $H_2SO_4$ counter solution at a temperature of 22° C. Dewulf, D. W., A. J. Bard, Cat. Lett. 1, 73, (1988).

The $CO_2$ reduction has previously been indicated to be highly dependent upon platinum electrode surface morphology in the production of HCOOH. Czerwinski, A., J. Sobkowski and R. Marassi, Anal. Lett., 18, 1717 (1985). Simultaneous in situ deposition of nickel as an electrocatalyst in the electrochemical hydrogenation of organic molecules has proven effective for obtaining high activity catalytic sites. Lain, M. J. and D. Pletcher, Electrochim. Acta., 32, 99 (1987).

SUMMARY OF THE INVENTION

The process of this invention provides electrochemical reduction of $CO_2$ to $CH_4$ and $C_2H_4$ at both high current densities and high Faradaic efficiencies. Faradaic yields of hydrocarbons by the electrochemical reduction of $CO_2$ according to this invention can be in order of 98 percent at 8.3 mA/cm$^2$ and about 79 percent at an increased current density of 25 mA/cm$^2$. We have found that to obtain such high Faradaic yields at high current densities by the electrochemical reduction of $CO_2$, it is important to provide a cathode surface of in situ deposited uniformly granular copper over the entire cathode substrate. Suitable in situ copper deposition may be achieved in any suitable electrolytic cell wherein the cathode substrate is a suitable electrically conducting metal substance upon which copper can be deposited immersed in an aqueous inorganic salt electrolyte in which $CO_2$ is soluble and comprising a copper cation supply material which will form copper cations under electrolytic cell operating conditions without interfering with the anodic reaction. In preferred embodiments, glassy carbon is a suitable cathode substrate material, $KHCO_3$ is a suitable aqueous electrolyte, and $CuSO_4$ is a suitable copper cation supply material. Cathode surface copper can be continuously or intermittently deposited during the $CO_2$ reduction process or the cathode copper surface can be periodically regenerated by anodic polarization followed by copper redeposition.

DESCRIPTION OF PREFERRED EMBODIMENTS

The process for electrochemical reduction of $CO_2$ to $CH_4$ and $C_2H_4$ at high current densities and high Faradaic efficiencies may be conducted in any suitable electrochemical cell configuration wherein the cell comprises an anode and a cathode in contact with an electrolyte and means for passing a current between the anode and cathode. The anode may be any suitable electrically conducting metal substance suitable for effective electrolytic cell operation, such as platinum, nickel, lead, glassy carbon, Ebony and titanium, preferably nickel, glassy carbon and lead. Suitable cathodes include any electrically conducting metal substrate upon which copper may be deposited. Suitable cathode substrates include glassy carbon, copper and metals of the 3d, 4d and 5d transition series, preferably glassy carbon and copper. To obtain even and complete electrode position of copper granules on the surface of the cathode, it is preferred that the cathode surface be highly polished by any suitable means known to the art, such as by very fine, 0.05 micron, alumina paste.

Any aqueous inorganic salt solution in which $CO_2$ is soluble and which does not provide interfering ions may be used as an electrolyte, such as aqueous solutions of $KHCO_3$, $NaHCO_3$, KCl, $KClO_4$, KOH, $KBF_4$, $K_2CO_3$, $K_2SO_4$, $KHSO_4$, $KH_2PO_4$, $K_2HPO_4$, preferably $KHCO_3$ or $NaHCO_3$ in concentrations of about 0.3 to 0.8 Molar, preferably about 0.4 to 0.6 Molar at pH preferably of about 4 to about 9. However, ammonia containing compounds and tetraalkyl cations must be avoided. The electrolyte also comprises a suitable copper ion supply material, which is any inorganic copper salt which will form copper cations under electrolytic cell operating conditions without interfering with the anodic reaction, such as $CuSO_4$, $Cu(NO_3)_2$, $Cu(BrO_3)_2$ and $Cu(BO_2)_2$. The electrolyte has a high content of dissolved $CO_2$ and is preferably saturated with $CO_2$, at least in the region of the cathode.

While the process of this invention may be conducted in a single electrolyte cell, it is preferred that the process be conducted in a separated cell wherein the separator is any suitable hydrogen ion passing membrane, such as Nafion 417, Nafion 117, fiber cloth comprising fibers of glass or polypropylene or PVC or Teflon or Nylon, porous plastics of polyethylene or PVC or Teflon. When a separated electrochemical cell is used, the above electrolytes are suitable for use as catholytes, and the copper supply material is within the catholyte which provides better control of the operating cell for desired intimate contact of the $CO_2$ with the freshly in situ deposited copper cathode surface. When the separated electrochemical cell is used, the anolyte may be different from the catholyte, but preferably, the anolyte is the same as the catholyte but does not contain the copper supply material nor the $CO_2$. Flowing catholytes or electrolytes may be used to more readily provide extra cellular chemical treatment or control of the catholyte or electrolyte.

We have found in the electrochemical reduction of $CO_2$ to $CH_4$ and $C_2H_4$ according to the present invention that Faradaic yields for $CH_4$ and $C_2H_4$ are little affected over an electrolyte pH range of about 9 to 6.5. Conduct of the electrochemical reduction at current densities of 10 to 55 mA/cm$^2$ shows a peak of about 7 times the Faradaic efficiency for $CH_4$ as for $C_2H_4$ at 0°, while reversing itself to a peak of $C_2H_4$ production about 2 times that of $CH_4$ production at 27° C. At both 0° C. and 27° C., the dependency of Faradaic efficiency on current density went through a common maximum for both $CH_4$ and $C_2H_4$ with the peak at 0° being at a current density of about 25 mA/cm$^2$ and about 30 mA/cm$^2$ at 27° C.

While we do not wish to be bound by any mechanism for the process of this invention, our work indicates the reduction of $CO_2$ to $CH_4$ and $C_2H_4$ may follow the reaction path:

1. Electron transfer step to $CO_2$ adsorbed on cathode:

$$CO_{2\,ads} + e^- \rightarrow CO_2^{\overset{o}{-}}{}_{ads}$$

2. Electron transfer forming adsorbed formic acid:

$$CO_2^{\overset{o}{-}}{}_{ads} + H_2O \longrightarrow .CO_2H_{ads} + OH^-$$

(carboxy radical intermediate)

$$.CO_2H_{ads} + H_2O + e^- \longrightarrow :C(OH)_{2\,ads} + OH^-$$

(oxymethylene)

$$:C(OH)_{2\,ads} \longrightarrow HCOOH_{ads}$$

3. Reduction of adsorbed formic acid:

$$HCOOH_{ads} + e^- \rightarrow HCOOH_{ads}^{\overset{o}{-}}$$

followed by $$HCOOH^{\overset{o}{-}} \rightarrow .CHO + OH^- \text{ or}$$

$$HCOOH^{\overset{o}{-}} \rightarrow HCOO^- + H\cdot$$

and an additional side reaction $$H\cdot + HCO_2^- \rightarrow H_2 + CO_2^{\overset{o}{-}}$$

4. Formation of product precursors:

$$HCOH_{ads} + e^- \rightarrow CH_{ads} + OH^-$$

$$CO \rightarrow C_{ads} + O_{ads}$$

$$C_{ads} + H_{ads} \rightarrow CH_{ads}$$

$$HCOH \rightleftharpoons HCHO \text{ (isomerization)}$$

5. $CH_4$ and $C_2H_4$ formation:

$$CH_{ads} + H_{ads} \rightarrow CH_{2\,ads}$$

$$CH_{2\,ads} + H_{ads} \rightarrow CH_{3\,ads}$$

$$CH_{3\,ads} + H_{ads} \rightarrow CH_4$$

$$2CH_2 \rightarrow C_2H_4$$

Further reaction pathways may lead to chain growth and formation of ethanol and propanol in addition to $CH_4$ and $C_2H_4$ according to this invention.

The process for electrochemical reduction of $CO_2$ to $CH_4$ and $C_2H_4$ at both high current densities and high Faradaic efficiencies is achieved by provision of a suitable electrochemical cell having a cathode of any electrically conducting substrate upon which copper can be deposited and a surrounding aqueous inorganic salt electrolyte in which $CO_2$ is soluble and comprising a copper supply material which will form copper cations under electrolytic cell operating conditions without interfering with the anodic reaction. A current providing a current density of about 5 to about 50 mA/cm$^2$ is passed between the anode and cathode electrode positing copper ions from the electrolyte forming granular copper on the cathode substrate surface in situ. The cathode substrate surface is covered with finely divided copper particles following about 5 to 15 minutes cell operation. Cathode surface copper electrode position may take place continuously or intermittently during the $CO_2$ reduction process or the entire cathode copper surface may be periodically regenerated by anodic polarization followed by copper redeposition to assure fresh in situ deposited copper surface of the cathode substrate. The $CO_2$ gas may then be passed through the electrolyte in the proximity of the in situ electrodeposited copper cathode surface wherein at least a portion of the $CO_2$ is reduced to $CH_4$ and $C_2H_4$ at the in situ deposited copper cathode surface, as more fully described above. Gaseous products comprising $CH_4$ and $C_2H_4$ are removed from the electrolyte in the region of the cathode and may be separated or further treated as desired in any extra cellular process.

The following examples set forth specific materials and process conditions in detail and are only intended to exemplify the invention and not to limit it in any way.

EXAMPLE I

A glassy carbon (Electrosynthesis Co.) cathode used as a substrate for copper deposition was initially polished with respectively 1, 0.3 and 0.05 micron alumina paste (Alpha Micropolish II). Current collection to the cathode was via a copper wire attached using silver epoxy (Epotec). The electrode assembly was appropriately insulated (Chem Grip epoxy) so that only the front face (0.2 to 0.3 cm$^2$) was exposed to the electrolyte. All electrolyses were performed in a glass H-cell with separation between anolyte and catholyte compartments being achieved by a Nafion 417 membrane (0.017 in, $H^+$ Form, equivalent weight 1100). The anode was platinum and 0.5M $KHCO_3$ was used for both anolyte and catholyte with $5\times10^{-4}$M $CuSO_4$ being initially present in the catholyte. The catholyte was sprayed with $CO_2$ through a glass frit (25–50$\mu$ pore size) for 30 minutes prior to initiating electrolysis. The $CO_2$ used was initially passed through a hydrocarbon trap (Chemical Research Supplies, Inc.) for removal of any $CH_4$ traces initially present in the gas stream, and then subsequently passed through an oxygen trap (Oxy-Trap, Alltech Associates) prior to being introduced into the electrolysis cell. All electrolyses were performed during continuous $CO_2$ catholyte sparge with the glass frit placed in close proximity to the working electrode. Analysis of the $CO_2$ gas stream before and after passage through this electrolysis cell was performed using a GOW-MAC Model 69-750 FID gas chromatograph using a 6'×⅛" stainless steel column packed with 80/100 mesh Carbosphere (Alltech Associates). No $CH_4$ could be detected in the $CO_2$ gas stream after the hydrocarbon trap and prior to the electrolysis cell. Constant-voltage and constant-current electrolyses were controlled via a Stonehart BC 1200 potentiostat/-galvanostat.

Constant current electrolyses were performed at 0° C. in the above described cell at different specified current densities set forth in Table 1. Each current density was maintained for 15 minutes prior to GC analysis of the exit gas stream. It is probable that the majority of copper deposition onto the glassy carbon working electrode occurred during the first ten minutes of electrolysis, followed by the later continuous deposition of remaining trace copper from the catholyte. During cell operation in situ deposited copper at the working electrode in this oxygen free electrolyte was probably cathodically protected against oxide formation.

Under conditions where a uniform finely granular in situ Cu deposit was produced covering all of the electrode surface, the corresponding Faradaic yields for $CH_4$ and $C_2H_4$ are summarized in Table 1 as a function of current density.

TABLE 1

| Current Density mA/cm$^2$ | Faradaic Efficiency $CH_4$ (%) | $C_2H_4$ (%) |
|---|---|---|
| 8.3 | 73 | 25 |
| 16.7 | 70 | 15 |
| 25.0 | 68 | 11 |

As can be seen at 8.3 mA/cm$^2$ the $CO_2$ reduction reaction was almost Faradaic. Even at 25 mA/cm$^2$ the overall Faradaic efficiency for $CO_2$ reduction products was 79 percent. These are by far the highest Faradaic efficiencies yet reported for this $CO_2$ reduction reaction. The significant preliminary observation here was the importance of freshly in situ deposited copper on the glassy carbon substrate, together with the possibility of copper being continuously deposited as the $CO_2$ reduction reaction proceeds, in order to achieve these high Faradaic efficiencies.

EXAMPLE II

An electrolysis cell as described in Example I except that the granular copper deposit covered only about one-third of the surface of the glassy carbon electrode substate was used for constant current electrolysis under the same conditions resulting in Faradaic efficiencies for $CO_2$ reduction to $CH_4$ and $C_2H_4$ as summarized in Table 2:

TABLE 2

| Current Density mA/cm$^2$ | Faradaic Efficiency $CH_4$ (%) | $C_2H_4$ (%) |
|---|---|---|
| 10 | 50 | 11 |
| 10 | 21 | 11 |
| 15 | 15 | 12 |
| 20 | 18 | 14 |
| 25 | 12 | 14 |
| 30 | 12 | 12 |

The importance of a uniform granular copper deposit over the entire glassy carbon substrate can be seen by reference to results summarized in Table 2, where a non-uniform copper deposit was present. Even under the conditions of this example, Faradaic efficiencies for both $CH_4$ and $C_2H_4$ were 61 percent at 10 mA/cm$^2$ but deteriorated to 24 percent at 30 mA/cm$^2$. In several instances ethane was also detected at concentrations $<0.1$ percent.

EXAMPLE III

To ascertain possible contribution of glassy carbon from a cathode as a carbon source for methane formation, a glassy carbon cathode was used in an electrochemical cell having 0.5M $KHCO_3$ electrolyte saturated with $CO_2$ in the cathode compartment. Electrolysis was conducted at 0° C. for 60 minutes at a current density of 20 mA/cm$^2$. Less than 0.1 percent Faradaic yield of methane and no ethylene was detected.

Electrolysis was conducted in a similar cell with a catholyte of 0.25M $K_2SO_4$ containing $5\times10^{-4}$M $CuSO_4$ under continuous $N_2$ purge at current densities of 10 to 50 mA/cm$^2$. No hydrocarbon products were observed by gas chromotographic analysis of the exiting gas stream. Another similar electrolysis was conducted using 0.25M $Na_2SO_4$ with the product gas showing no hydrocarbons. These electrolyses show that deposited copper on the glassy carbon substrate does not catalyze substrate reduction to result in gaseous hydrocarbon products.

While in the foregoing specification this invention has been described in relation to certain preferred embodiments thereof, and many details have been set forth for purpose of illustration, it will be apparent to those skilled in the art that the invention is susceptible to additional embodiments and that certain of the details described herein can be varied considerably without departing from the basic principles of the invention.

I claim:

1. A process for electrochemical reduction of $CO_2$ to $CH_4$ and $C_2H_4$ at both high current densities and high Faradaic efficiencies in an electrochemical cell comprising an anode an a cathode in contact with an electrolyte, said process comprising: passing a current between said anode and said cathode; electrodepositing Cu ions form an electrolyte comprising an aqueous inorganic salt solution in which $CO_2$ is soluble and Cu ions forming deposited uniformly granular Cu on a highly polished cathode surface in situ; passing $CO_2$ through said electrolyte and contacting said cathode surface; reducing at least a portion of said $CO_2$ to $CH_4$ and $C_2H_4$ at said in situ deposited Cu cathode surface; removing gaseous products comprising $CH_4$ and $C_2H_4$ form said electrolyte.

2. A process according to claim 1 wherein said inorganic salt is in a concentration of about 0.3 to about 0.8 Molar and said electrolyte is at a pH of about 4 to 9.

3. A process according to claim 1 wherein said electrolyte inorganic salt is selected from the group consisting of $KHCO_3$, $NaHCO_3$, KCl, $KClO_4$, KOH, $KBF_4$, $K_2CO_3$, $K_2SO_4$, $KHSO_4$ $KH_2PO_4$ and $K_2HPO_4$.

4. A process according to claim 3 wherein said Cu ions are supplied by a copper compound selected from the group consisting of $CuSO_4$, $Cu(NO_3)_2$, $Cu(BrO_3)_2$ and $Cu(BO_2)_2$.

5. A process according to claim 1 wherein said cathode comprises a metal substrate selected from the group consisting of glassy carbon, copper, and metals of the 3d, 4d and 5d transition series.

6. A process according to claim 1 wherein said cathode comprises a metal substrate selected from the group consisting of glassy carbon and copper.

7. A process according to claim 1 wherein said electrolyte is separated by an $H^{30}$ ion passing separator into an anolyte and a catholyte, said electrodepositing Cu ions forming granular Cu on said cathode surface in situ and said passing $CO_2$ and contacting said cathode surface taking place in said catholyte.

8. A process according to claim 1 wherein said current is in an amount to result in current densities on said cathode of about 5 to about 50 mA/cm$^2$.

9. A process according to claim 1 wherein said current is in an amount to result in current densities on said cathode of about 20 to about 30 mA/cm$^2$.

10. A process according to claim 1 wherein said electrolyte is maintained at a temperature about 0° to about 30° C.

11. A process according to claim 1 wherein said electrolyte is maintained at a temperature about 0° to about 10° C. for preferential $CH_4$ production.

12. A process according to claim 1 wherein said electrolyte is maintained at a temperature about 20° to about 30° C. for preferential $C_2H_4$ production.

13. A process according to claim 1 wherein said granular Cu is continuously formed on said cathode surface to provide fresh in situ deposited Cu.

14. A process according to claim 1 wherein said granular Cu is intermittently formed on said cathode surface to provide fresh in situ deposited Cu.

15. A process according to claim 1 wherein said granular Cu cathode surface is periodically regenerated by anodic polarization followed by said electrodepositing Cu ions forming granular Cu on said cathode surface in situ to provide fresh in situ deposited Cu.

16. In a process for electrochemical reduction of $CO_2$ to $CH_4$ and $C_2H_4$ at both high current densities and high Faradaic efficiencies in an electrochemical cell comprising an anode and a cathode in contact with an electrolyte, wherein the improvement in the cathode half cell comprises: electrodepositing Cu ions form an electrolyte comprising an aqueous inorganic salt solution in which $CO_2$ is soluble and Cu ions forming in situ deposited uniformly granular Cu on a highly polished cathode surface; passing $CO_2$ through said elctrolyte and contacting said in situ deposited Cu cathode surface; reducing at least a portion of said $CO_2$ to $CH_4$ and $C_2H_4$ at said in situ deposited Cu cathode surface.

17. In a process according to claim 16 wherein said electrolyte is an aqueous inorganic salt solution in which $CO_2$ is soluble and said inorganic salt is a concentration of about 0.3 to about 0.8 Molar and said electrolyte is at a pH of about 4 to about 9.

18. In a process according to claim 17 wherein said electrolyte inorganic salt is selected from the group consisting of $KHCO_3$, $NaHCO_3$, KCl, $KClO_4$, KOH, $KBF_4$, $K_2CO_3$, $K_2SO_4$, $KHSO_4$, $KH_2PO_4$ and $K_2HPO_4$.

19. In a process according to claim 17 wherein said Cu ions are supplied by a copper compound selected from the group consisting of $CuSO_4$, $Cu(NO_3)_2$, $Cu(BrO_3)_2$ and $Cu(BO_2)_2$.

20. In a process according to claim 17 wherein said cathode comprises a metal selected from the group consisting of glassy carbon, copper, and metal of the 3d, 4d and 5d transition series.

21. In a process according to claim 17 wherein said current is in an amount to result in current densities on said cathode of about 5 to about 50 mA/cm$^2$.

22. In a process according to claim 17 wherein said current is in an amount to result in current densities on said cathode of about 20 to about 30 mA/cm$^2$.

23. In a process according to claim 17 wherein said electrolyte is maintained at a temperature about 0° to about 30° C.

24. In a process according to claim 17 wherein said granular Cu is continuously formed on said cathode surface to provide fresh in situ deposited Cu.

25. In a process according to claim 17 wherein said granular Cu is intermittently formed on said cathode surface to provide fresh in situ deposited Cu.

26. In a process according to claim 17 wherein said granular Cu cathode surface is periodically regenerated by anodic polarization followed by said electrodepositing Cu ions forming granular Cu on said cathode surface in situ to provide fresh in situ deposited Cu.

* * * * *